US010981049B2

(12) United States Patent
McGetrick

(10) Patent No.: US 10,981,049 B2
(45) Date of Patent: Apr. 20, 2021

(54) BOARD GAME SYSTEM. METHOD OF USE, AND METHOD OF ASSEMBLY

(71) Applicant: Kyle P. McGetrick, Santa Barbara, CA (US)

(72) Inventor: Kyle P. McGetrick, Santa Barbara, CA (US)

( * ) Notice: Subject to any disclaimer, the term of this patent is extended or adjusted under 35 U.S.C. 154(b) by 0 days.

(21) Appl. No.: 16/791,259

(22) Filed: Feb. 14, 2020

(65) Prior Publication Data

US 2020/0261791 A1 Aug. 20, 2020

Related U.S. Application Data

(60) Provisional application No. 62/805,553, filed on Feb. 14, 2019.

(51) Int. Cl.
*A63F 9/02* (2006.01)
*A63F 3/00* (2006.01)

(52) U.S. Cl.
CPC ..... *A63F 9/0208* (2013.01); *A63F 3/00006* (2013.01); *A63F 3/00261* (2013.01); *A63F 9/0243* (2013.01); *A63F 9/0278* (2013.01); *A63F 2003/00268* (2013.01); *A63F 2003/00302* (2013.01); *A63F 2009/0213* (2013.01); *A63F 2009/0282* (2013.01)

(58) Field of Classification Search
CPC .... A63F 9/0208; A63F 9/0243; A63F 9/0278; A63F 3/00006; A63F 3/00261; A63F 2003/00302; A63F 2003/00268; A63F 2009/0213; A63F 2009/0282
USPC ..... 273/332
See application file for complete search history.

(56) References Cited

U.S. PATENT DOCUMENTS

| | | | | |
|---|---|---|---|---|
| 1,052,907 | A | 2/1913 | Fergusson | |
| 1,121,353 | A | 12/1914 | Grikscheit | |
| 1,398,511 | A | 11/1921 | Hanrath | |
| 2,095,390 | A | 10/1937 | Lange et al. | |
| 2,147,176 | A | 2/1939 | Ronzone | |
| 2,466,069 | A * | 4/1949 | Babigian | A63F 9/0247 273/351 |
| 2,942,886 | A | 6/1960 | Ackerman | |
| 2,950,917 | A | 8/1960 | Lyon | |
| 2,950,918 | A | 8/1960 | Lyon | |
| 2,991,034 | A | 7/1961 | Lyon | |
| 3,009,702 | A | 11/1961 | Lyon | |
| 3,023,001 | A | 2/1962 | Gourdouze | |
| 3,051,491 | A | 8/1962 | Cabot | |
| 3,288,466 | A * | 11/1966 | Cumings | A63B 69/0079 473/430 |

(Continued)

*Primary Examiner* — Vishu K Mendiratta
(74) *Attorney, Agent, or Firm* — Law Office of Mark Brown, LLC; Christopher M. DeBacker

(57) ABSTRACT

A board game featuring a board having a removable rotatable tower having an arm extending away from it and a hook for receiving a ring hung from a string from the arm. Players move their pieces about the board. Cards may be drawn at random intervals. The player may be required to toss the ring towards the hook located on the tower. Successfully hooking the ring to the tower may affect the outcome of the player's turn. The tower may be rotated on the board, so that each player can swing the ring, depending on outcomes from the various features of the game, including the cards, dice rolls, and space locations on the game board.

1 Claim, 7 Drawing Sheets

(56) References Cited

U.S. PATENT DOCUMENTS

| | | | | | |
|---|---|---|---|---|---|
| 3,520,535 | A | * | 7/1970 | McGlade | A63F 9/02 273/332 |
| 3,656,747 | A | | 4/1972 | Revell, Jr. | |
| 3,870,312 | A | * | 3/1975 | Hannan | A63F 9/00 273/276 |
| 4,037,844 | A | * | 7/1977 | LaMonica | A63F 3/00895 273/287 |
| 4,120,498 | A | | 10/1978 | Mutschler et al. | |
| 4,359,226 | A | * | 11/1982 | Neff | A63F 3/001 273/243 |
| 4,375,890 | A | * | 3/1983 | Thomas | A63B 67/22 473/507 |
| 4,564,200 | A | | 1/1986 | Loring et al. | |
| 4,635,942 | A | | 1/1987 | Flaherty, Jr. | |
| 5,171,019 | A | | 12/1992 | Arnette | |
| 5,337,996 | A | | 8/1994 | Kalish | |
| 7,896,349 | B2 | * | 3/2011 | Pershin | A63B 67/10 273/332 |
| 8,011,664 | B2 | | 9/2011 | Hilbert, Jr. et al. | |
| 8,720,895 | B2 | | 5/2014 | Matthis | |
| 8,720,896 | B2 | | 5/2014 | Matthis | |
| 9,267,769 | B1 | | 2/2016 | Gempler | |
| 2009/0206550 | A1 | | 8/2009 | Pershin et al. | |
| 2014/0049007 | A1 | | 2/2014 | McGetrick et al. | |
| 2015/0115530 | A1 | | 4/2015 | Vanston | |
| 2016/0339315 | A1 | | 11/2016 | McGetrick | |
| 2016/0339333 | A1 | | 11/2016 | McGetrick | |

* cited by examiner

BOARD GAME SYSTEM. METHOD OF USE, AND METHOD OF ASSEMBLY

CROSS-REFERENCE TO RELATED APPLICATION

This application claims priority in U.S. Provisional Patent Application No. 62/805,553 Filed Feb. 14, 2019, which is incorporated herein by reference.

BACKGROUND OF THE INVENTION

1. Field of the Invention

The present invention relates generally to a board game and method for use thereof, and more specifically to a board game including a tossable ring and hook element.

2. Description of the Related Art

Games having boards with movement tiles, cards, and dice are known in the art. However, these games generally follow the same rules and lack challenging elements to the game which can enhance the fun decrease the level of randomness by increasing the effect of skill on the game.

Heretofore there has not been available a system or method for a board game with the advantages and features of the present invention.

BRIEF SUMMARY OF THE INVENTION

The present invention generally provides a board game featuring a board having multiple tiles for moving pieces through the board, dice, cards, and a removable rotatable tower having an arm extending away from it and a hook for receiving a ring hung from a string from the arm.

As is typical with board games, the players move their pieces about the board along the tiles. Rolling the dice may affect how many tiles a user moves their playing piece. Cards may be drawn at random intervals depending on where the player's game piece lands amongst the tiles, or cards may be drawn at regular intervals as defined by the rules of the game.

During their turn, a player is often required to toss the ring towards the hook located on the tower. Successfully hooking the ring to the tower may affect the outcome of the user's turn. The tower may be rotated on the board, so that each player can swing the ring, depending on outcomes from the various features of the game, including the cards, dice rolls, and tile locations.

The tower is removable from the board and when attached is secured to the board using a screw, a base, or some other element to provide a secure, temporary connection to the board while allowing the tower to rotate. When disassembled, the tower can be taken off of the board and the hook and the arm may be optionally removed from the tower for easy and compact storage.

The inclusion of the tower with the hook-and-ring element provides an element of skill to a game that may otherwise be largely based on chance between dice rolls and card draws. This separates the present invention as presented from existing games by including this skill-based element. The hook and ring could be replaced with a ball and hoop as well, and multiple hooks or hoops could be included to increase or decrease the skill requirement.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
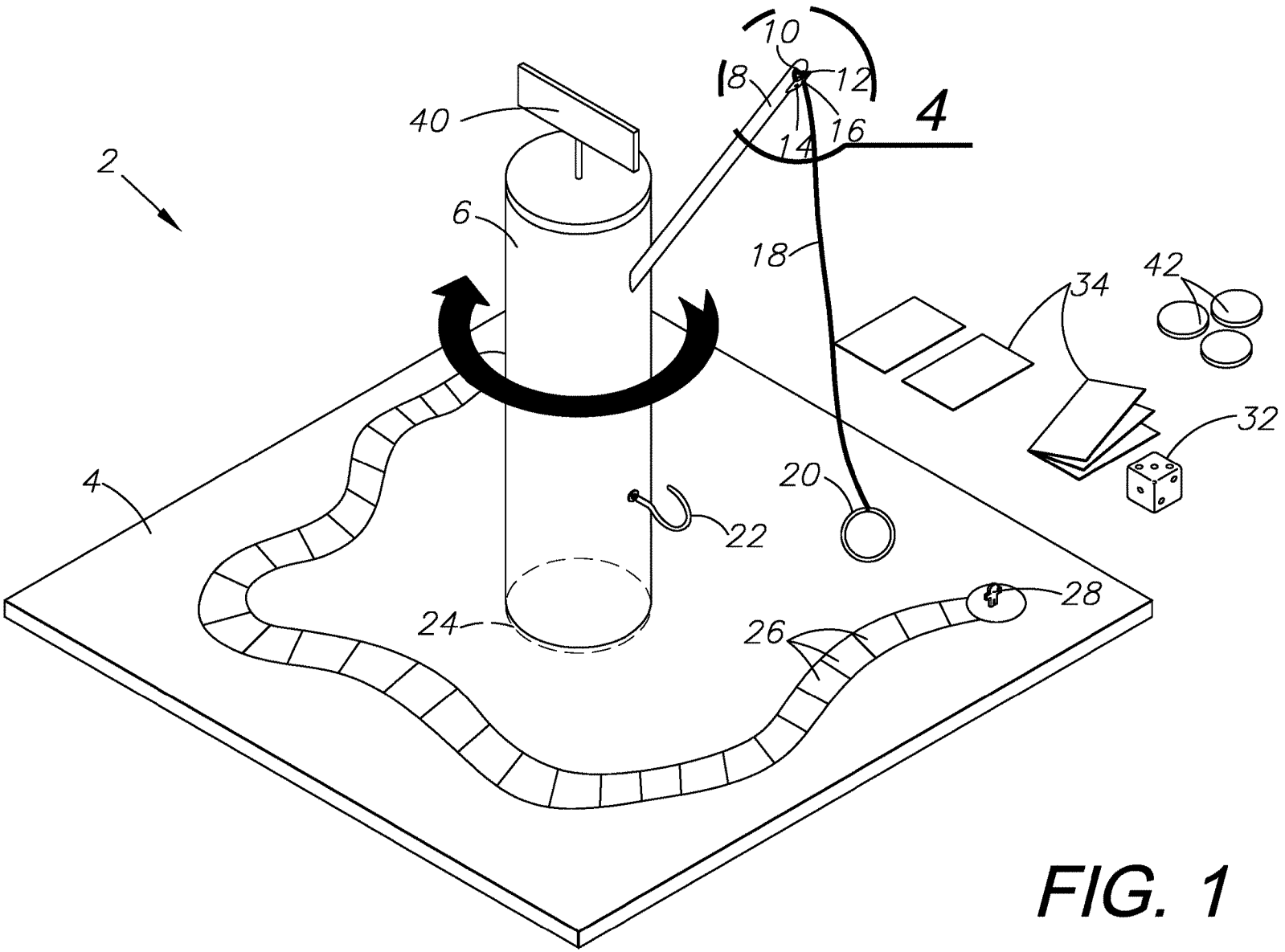
FIG. 1 is a three-dimensional isometric view of a preferred embodiment of the present invention in a fully assembled orientation.
Figure 2:
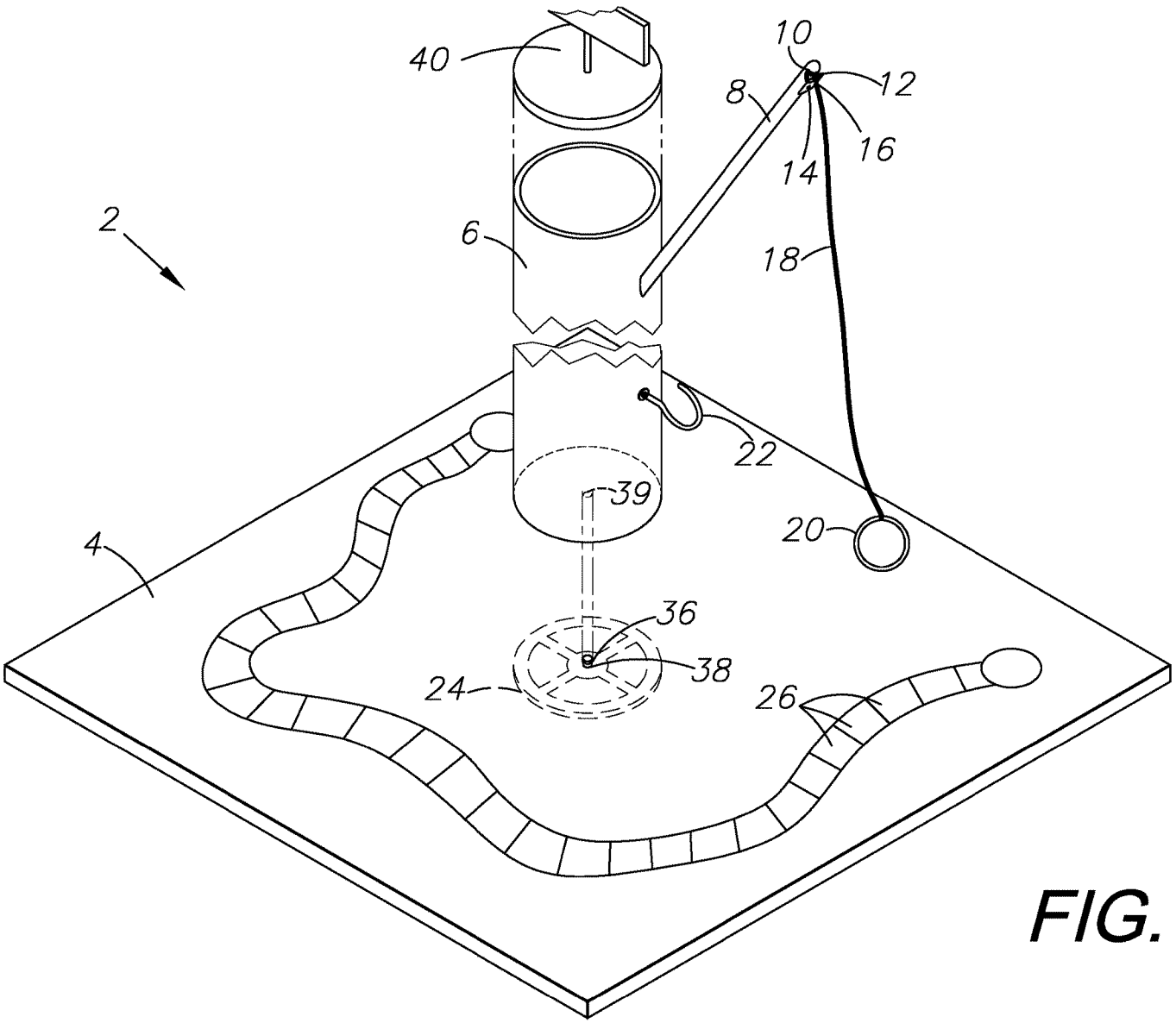
FIG. 2 is a partially exploded three-dimensional isometric view thereof.
Figure 3:
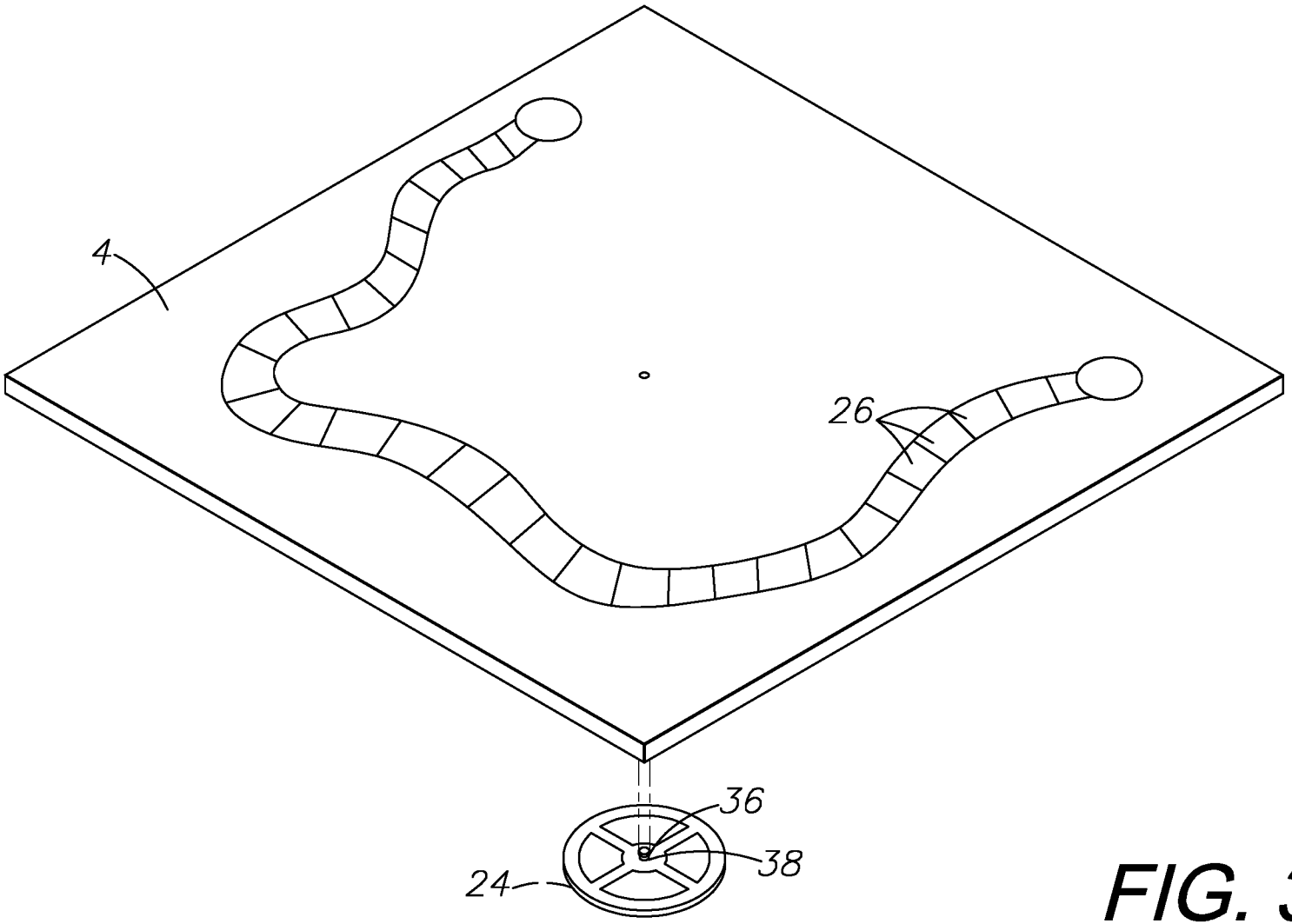
FIG. 3 is another partially exploded three-dimensional isometric view thereof.
Figure 4:
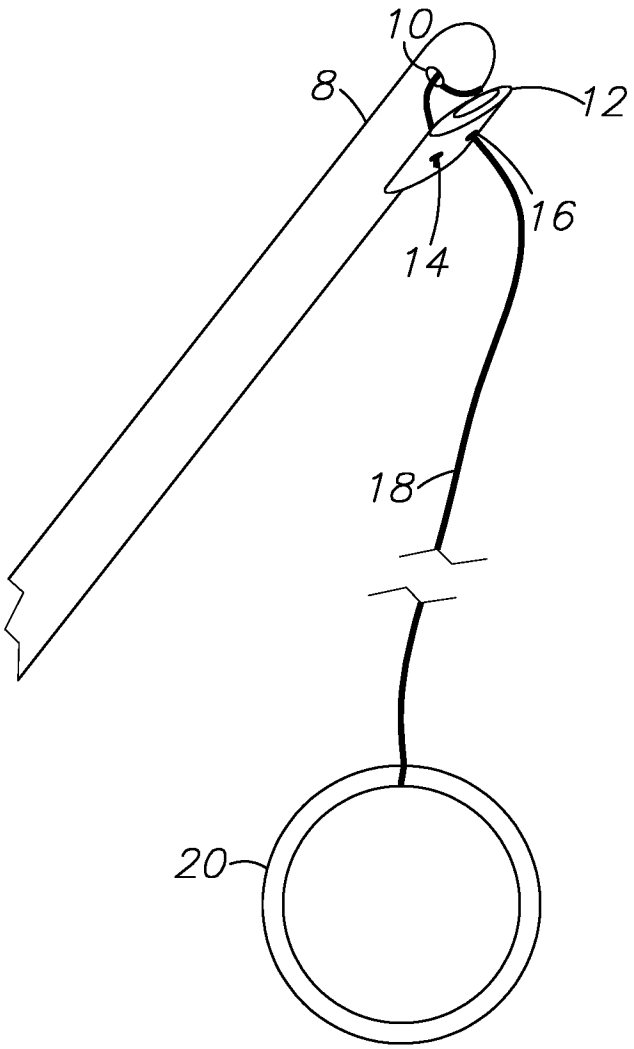
FIG. 4 is a detailed view taken about the circle of FIG. 1.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Game System 2

As shown in FIGS. 1-4, the present invention is a game system 2 including a game board 4 having several tiles 26 for moving playing pieces 28, playing cards 34, at least one die 32, tokens 42, and a central tower 6 which is mounted to the game board 4 on a mounting element 24. The mounting element 24 is affixed to the game board and the central tower can be rotatably and removably placed onto the mounting element.

The mounting element 24 can be connected to the board using a nodule 36 which passes through a hole 38 in the board 4 and connects to another hole 39 in the bottom of the tower 6. This allows the tower 6 to be rotated about the mounting element 24 so that each player around the board can access the tower, hook 22 and ring 20 when needed.

An optional cap 40 which may have a sign on it can be placed atop the tower 6.

An arm 8 is slotted into the side of the tower 6 during assembly. The ring 20 hangs from the arm 8 from a string 18 such that it can be tossed towards the hook 22 with the goal of securing the ring 20 onto the hook 22 as part of standard gameplay. A string lock 12 has a first 14 and second 16 hole, and another hole 10 passes through the end of the arm 8. The string is looped through the hole 10 in the arm and through the first 14 and second 16 holes of the string lock, such that the string remains secured about the end of the arm. This also allows for the user to easily adjust the length of the string 18 such that the ring 20 rests against the hook 22 with proper slack.

As the game is played, the central tower 6 is rotated as a regular part of gameplay. This may be performed at a standard interval or based upon actions taking during the game either through dice rolls, card actions, or when players land on particular tiles. At other periods during gameplay a user may be tasked at tossing the ring 20 hanging from the string 18 from the end of the arm 8 connected to the central tower towards the hook 22 inserted into the central tower. Different results during gameplay will occur depending on whether the user hooks the ring onto the hook or not. The arm 8 and hook 22 may be selectively removable from the tower for storage.

III. Method of Play of Board Game System 52

Figure 5:
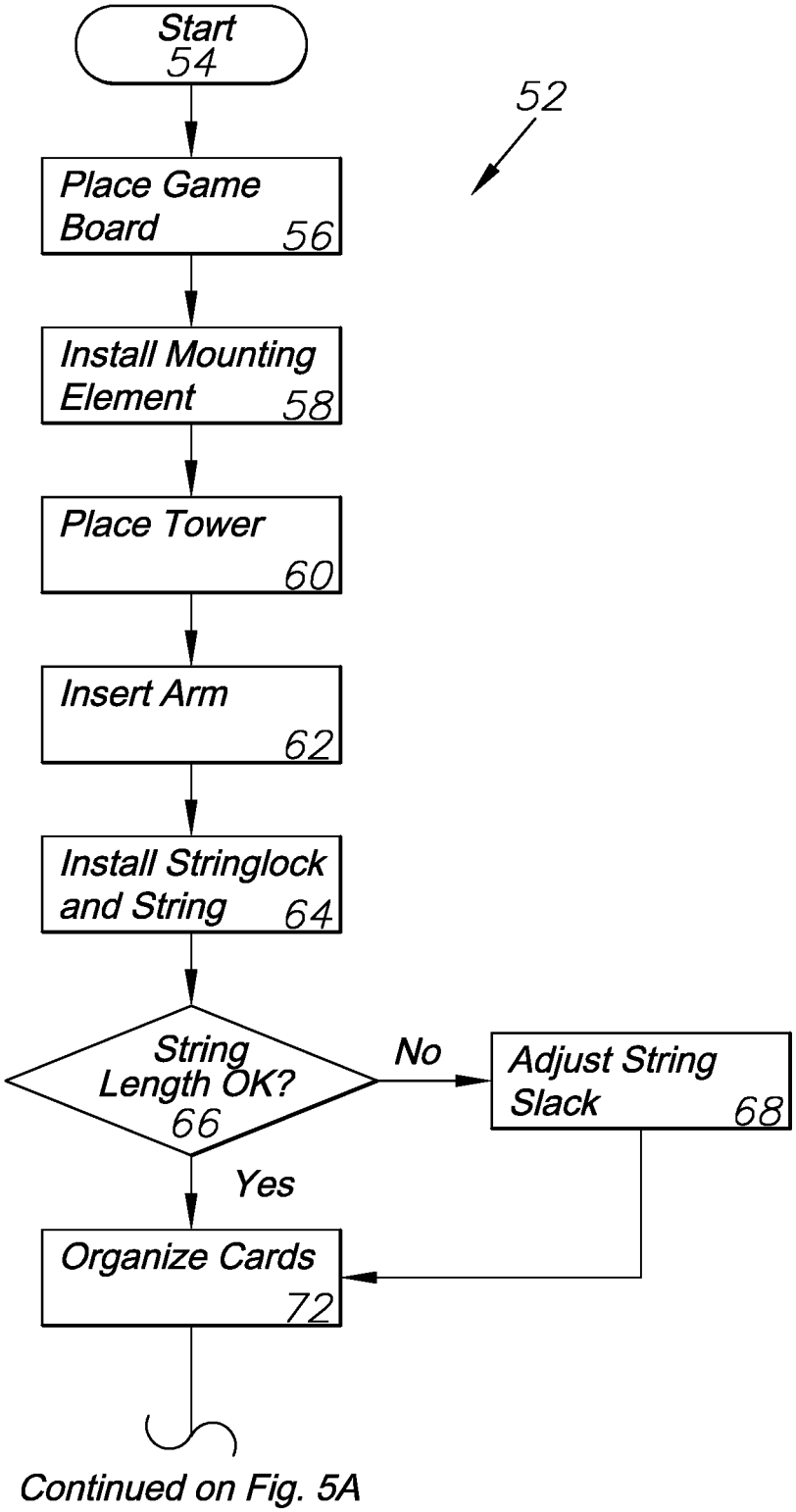
FIG. 5 is a flowchart diagramming the steps taken in practicing an embodiment of the present invention.
Figure 5A:
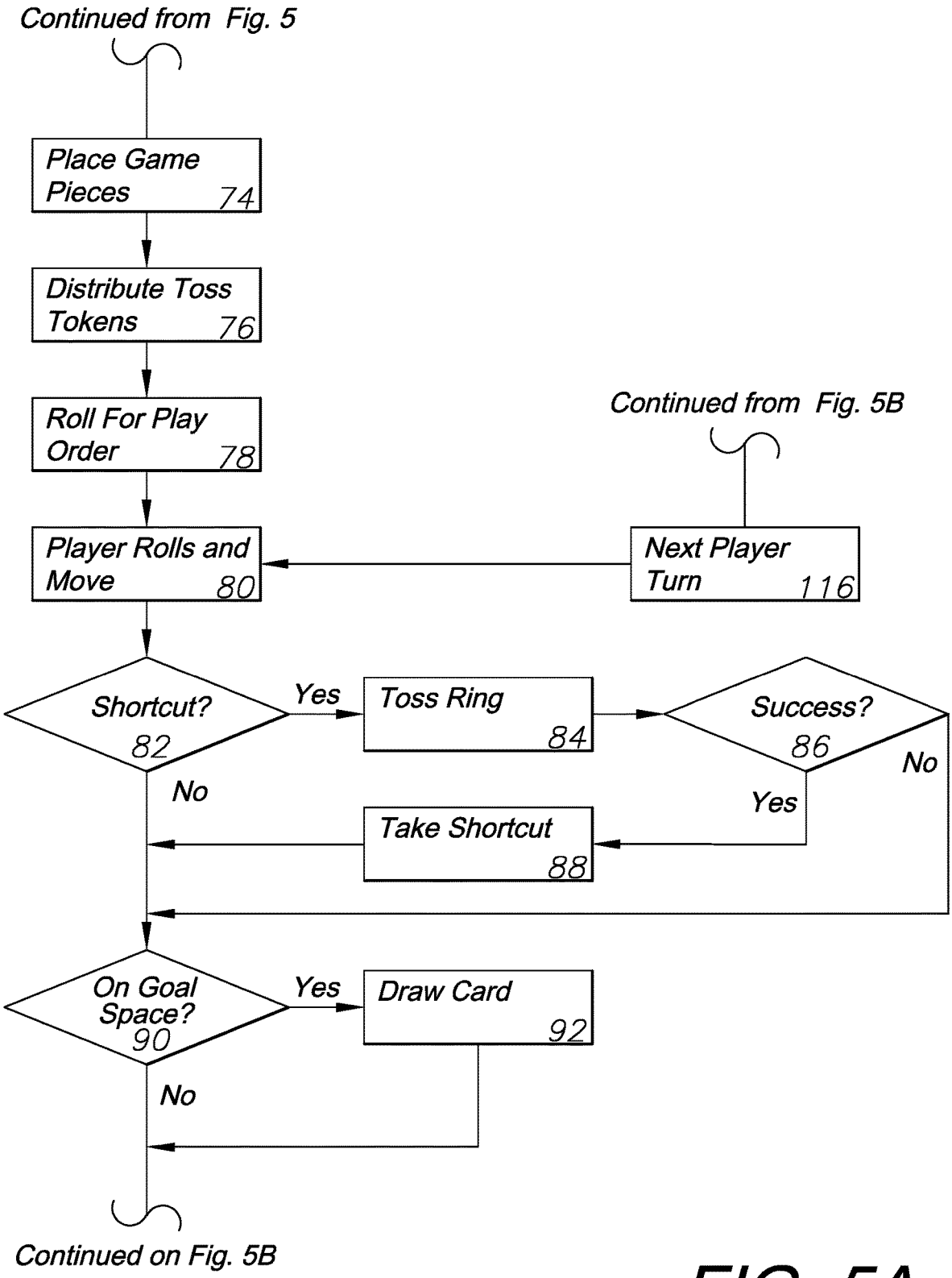
FIG. 5A is a flowchart continuing from FIG. 5.
Figure 5B:
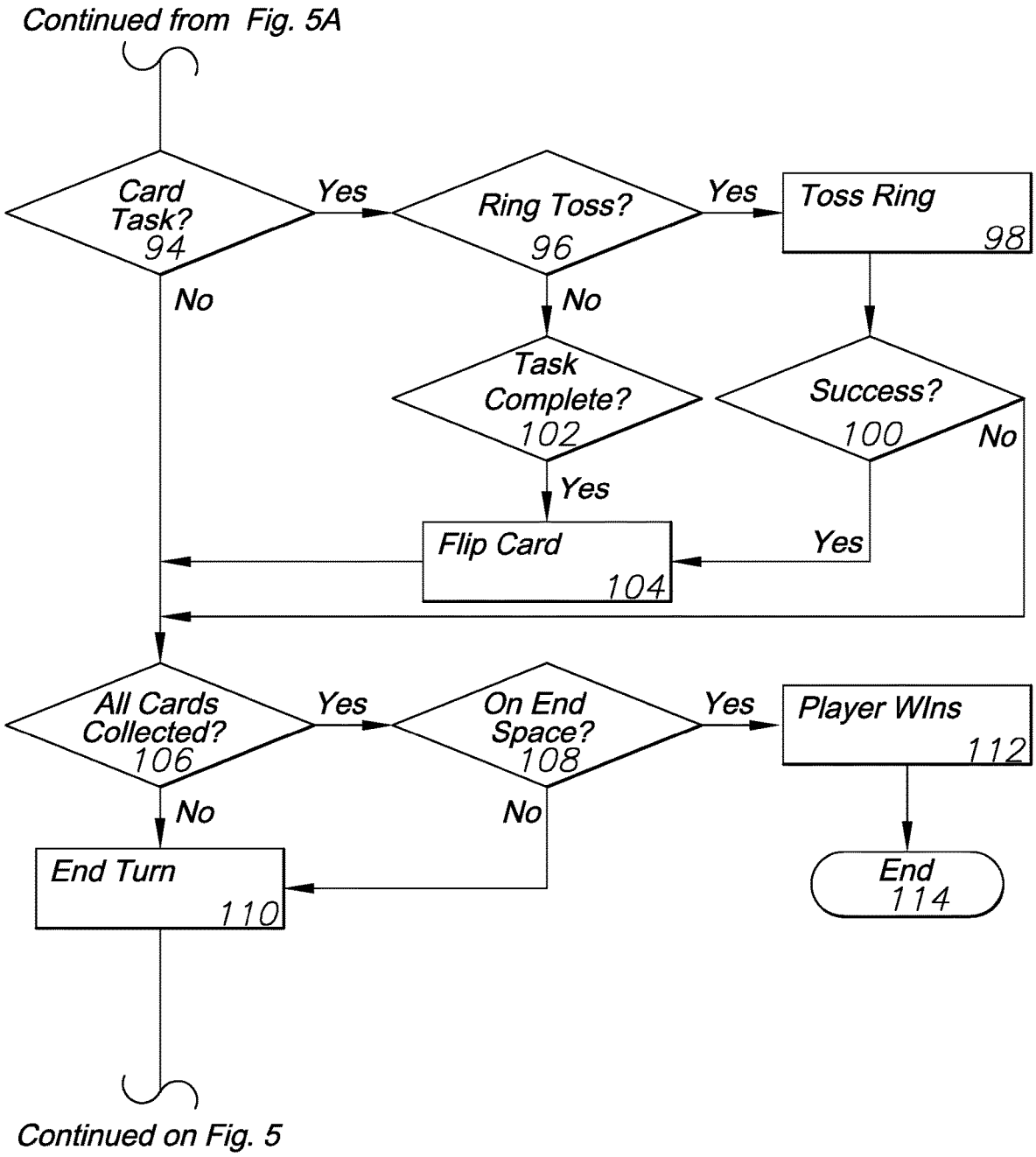
FIG. 5B is a flowchart continuing from FIG. 5A.

FIGS. 5, 5A, and 5B contain a flowchart demonstrating the steps of a typical play through of the game system 2 above. The process starts at 54 and the game board is removed from the box and placed on the playing surface at 56. The mounting element 24 is placed below the board at 58 and the tower 6 is placed atop the board over the mounting element at 60. The arm 8 is installed into the tower at 62, along with the string lock 12 and string 18 at 64. A check is determined at 66 whether the string length is the proper length by placing the ring 20 onto the hook 22 and determining if there is proper slack in the string. If no, the string length is adjusted at 68. The playing cards 34 are organized at 72 by placing them in their appropriate positions along the game board 4.

Continuing on FIG. 5A, the game pieces 28 corresponding with each player are placed along the game path 26 at 74, and the toss tokens 42 are distributed to each player at 76 to be used to track successful tosses of the tossable object towards the target. Once the game board and pieces are set up, the players roll the die 32 at 78 to determine the order for the players to play the game in. The player then rolls the die 32 (or multiple dice) and moves their game piece 28 at 80. The player's game piece may reside on or land on a shortcut tile at 82, allowing the player to attempt to toss the ring at 84. If there is a success at 86, the player can take the shortcut at 88. Otherwise the next step is to determine if the player's game piece resides on or lands on a goal space 90. If yes, the player will draw a card at 92. Either way the game checklist continues.

Continued on FIG. 5B, the player determines if they have a card task from any card earned this turn or from previous turns at 94. These tasks may require landing on a specific space 26 on the game board swinging the ring 20 at the hook 22 (once or multiple times) or even tossing the ring, moving to a specified location, and then re-tossing the ring. If a ring toss requirement is part of the card task at 96, then the user may toss the ring at 98. If there is a success 100, the player flips the card over 104 and that counts towards their winning condition. A winner must collect one of each variation of the task cards to win the game as described below. If there is no ring toss requirement at 96, the player determines if they have otherwise completed the task on the card at 102, such as by landing on the correct space 26. If yes, the player flips the card at 104. Otherwise the player moves on to the next step with no additional cards flipped.

A check is made at the end of the player's turn to see if all cards have been collected at 106. If yes, a check is made to determine if the player is on the correct "ending" space at 108. If yes, the player wins at 112 and the game ends at 114. Otherwise the player's turn ends at 110. Continued back on FIG. 5A, the next player's turn begins at 116 and the player rolls and moves at 80. This process continues until a player has collected all cards at 106 and have moved their game piece 28 to the correct space 26 at 110, resulting in a player winning at 112 and the game ending at 114.

It is to be understood that while certain embodiments and/or aspects of the invention have been shown and described, the invention is not limited thereto and encompasses various other embodiments and aspects. For example, the ring element could be replaced with a ball or other tossable object, and the hook element could be replaced with a hoop, basket, or other target or goal.

The invention claimed is:

1. A method of interacting with game system, the method comprising the steps:

placing a game board and connecting a mounting element against said game board such that a nodule of said mounting element is placed at a center point of said game board;

placing a rotatable tower onto said game board such that said rotatable tower engages with said nodule of said mounting element and is rotatable about said nodule of said mounting element;

connecting an arm to said rotatable tower via a first end of said arm;

connecting a first end of a string to said a second end of said arm, wherein a second end of said string is affixed to a tossable object, thereby suspending said tossable object from said second end of said arm;

connecting a target to said rotatable tower, said target configured to receive and retain said tossable object;

placing at least two game pieces on said game board;

playing the game by periodically rolling at least one dice and moving at least one of said at least two game pieces along a path of game spaces on said game board;

drawing a card from a plurality of cards during the course of play after moving said at least one of said at least two games pieces;

rotating said rotatable tower during course of play upon the meeting of specific criteria of game play; and tossing said tossable object toward said target.

* * * * *